United States Patent [19]

Oaku et al.

[11] Patent Number: 4,561,889

[45] Date of Patent: Dec. 31, 1985

[54] WEAR-RESISTANT SINTERED FERROUS ALLOY AND METHOD OF PRODUCING SAME

[75] Inventors: Takaaki Oaku, Yokosuka; Yasuzi Hokazono; Masahiko Shiota, both of Yokohama; Yoshihiro Maki, Miura, all of Japan

[73] Assignee: Nissan Motor Co., Ltd., Yokohama City, Japan

[21] Appl. No.: 545,245

[22] Filed: Oct. 25, 1983

[30] Foreign Application Priority Data

Nov. 26, 1982 [JP] Japan ..... 57-205951

[51] Int. Cl.[4] ..... C22C 38/16

[52] U.S. Cl. ..... 75/125; 75/126 A; 75/126 P; 75/130.5; 75/132; 419/2; 419/38; 419/46; 419/47; 419/48; 419/57; 419/58; 419/60

[58] Field of Search ..... 75/126 A, 126 P, 123 B, 75/126 K, 130.5, 132, 125; 419/2, 38, 46, 47, 48, 57, 58, 60

[56] References Cited

U.S. PATENT DOCUMENTS

| | | | |
|---|---|---|---|
| 3,977,838 | 8/1976 | Hashimoto et al. | 29/182.5 |
| 4,344,795 | 8/1982 | Endo et al. | 75/230 |
| 4,431,449 | 2/1984 | Dillon et al. | 419/38 X |
| 4,485,147 | 11/1984 | Nishino et al. | 419/47 X |
| 4,491,477 | 1/1985 | Suganuma et al. | 419/30 X |
| 4,504,312 | 3/1985 | Oaku et al. | 75/242 X |

*Primary Examiner*—Stephen J. Lechert, Jr.

*Attorney, Agent, or Firm*—Schwartz, Jeffery, Schwaab, Mack, Blumenthal & Evans

[57] ABSTRACT

A sintered ferrous alloy which is high in wear resistance and relatively weak in the tendency to abrade another metal material with which the sintered alloy makes rubbing contact and suitable for rocker arm tips in automotive engines for example. The sintered alloy is produced by compacting and sintering a powder mixture of 15–50 parts by weight of a Fe-Cr-B alloy powder, which contains 10–35% of Cr and 1.0–2.5% of B, 1.0–3.5 parts by weight of graphite powder, such an amount of a Cu-P alloy powder that the powder mixture contains 0.2–1.5% of P and 1.0–20.0% of Cu and the balance of an iron powder.

10 Claims, No Drawings

WEAR-RESISTANT SINTERED FERROUS ALLOY AND METHOD OF PRODUCING SAME

BACKGROUND OF THE INVENTION

This invention relates to a wear-resistant sintered ferrous alloy for parts subjected to rubbing friction and a method of producing the same.

A typical example of metal parts that are forced to make continuous rubbing contact with another metal part is the rocker arm of an internal combustion engine. The body of the rocker arm is formed by casting or by forging, but the tip part where the rocker arm makes rubbing contact with a cam must be afforded with high wear resistance. Therefore, it is usual to harden the tip portion of the rocker arm by a surface treatment such as carbrizing, nitriding, chromium plating or plasma-spraying of a hard coating material, or alternatively to form the tip part separately from the main part of the rocker arm by chilled casting or by a powder metallurgy method and attach the tip part to the rocker arm body by soldering or by insert-casting.

As the performance requirements to the recent internal combustion engines for automotive uses have become more and more severe, there is the tendency to force the rocker arms to make rubbing contact with the cams under severer conditions. Then there arises a problem that the rocker arm tip parts produced by conventional materials and techniques and/or the cam surfaces undergo intolerably significant wear.

SUMMARY OF THE INVENTION

It is an object of the present invention to provide a sintered alloy which has such high wear resistance as is sufficient for parts subjected to severe rubbing friction such as the rocker arm tips in recent automotive internal combustion engines but is relatively weak in the tendency to abrade another metal material brought into rubbing contact with the sintered alloy parts.

It is another object of the invention to provide a sintered alloy which is very high in wear resistance and can be produced at relatively low costs.

It is still another object of the invention to provide a method of producing a sintered alloy according to the invention.

The present invention provides a method of producing a wear-resistant sintered ferrous alloy, the method comprising the steps of preparing 100 parts by weight of a powder mixture by mixing 15 to 50 parts by weight of a Fe-Cr-B alloy which contains 10 to 35% by weight of Cr and 1.0 and 2.5% by weight of B, 1.0 to 3.5 parts by weight of a graphite powder, such an amount of a Cu-P alloy powder that the prepared powder mixture contains 0.2 to 1.5% by weight of P and 1.0 and 20.0% by weight of Cu and the balance of an iron powder, compacting the powder mixture into a body of a desired shape, and sintering the compacted body in a nonoxidizing atmosphere.

Preferably use is made of a Cu-P alloy containing 8 to 15% by weight of P, and it is also preferable that the amount of the Fe-Cr-B alloy powder in the initial step is in the range from 20 to 30 parts by weight. The iron powder may be either a substantially pure iron powder or a low-alloy iron powder.

As the product of the above stated method, a wear-resistant sintered ferrous alloy according to the invention consists essentially of 1.5 to 17.5% of Cr, 0.15 to 1.25% of B, 1.0 to 3.5% of C, 0.2 to 1.5% of P, 1.0 to 20.0% of Cu, all by weight, and the balance of Fe.

Preferably the content of Cr in this sintered alloy is in the range from 2.0 to 10.5% by weight and the content of B is in the range from 0.20 to 0.75% by weight. Also it is preferred that the porosity of the sintered alloy is not greater than 20%.

The matrix of a sintered alloy according to the invention is principally of iron, and adequate amounts of hard phases such as Fe-Cr-B-C and Fe-C-P compounds are dispersed in the iron matrix together with Cu in elemental form. This sintered alloy is very high in wear resistance but is relatively weak in the tendency to abrade another metal material with which the sintered alloy makes rubbing contact. That is, this sintered alloy is superior to other wear-resistant sintered ferrous alloys in fitting or physical affinity for different metal materials. Accordingly, when this sintered alloy is used for rocker arm tips in the recent automotive internal combustion engines both the rocker arm tips and the cam faces become very small in the amounts of wear. This sintered alloy does not use very costly metals such as Mo and W, and can easily be produced by using conventional powder metallurgy techniques. In principle this sintered alloy can be used in the state as sintered without the need of any post-sintering heat treatment or surface treatment. Accordingly various parts of this excellent sintered alloy can be produced at very low costs.

An important feature of the invention is the use of a Cu-P alloy powder as an essential component of the starting powder mixture so that the sintered alloy contains adequate amounts of P and Cu.

Our research-and-development group has already discovered that a sintered ferrous alloy very high in wear resistance and relatively weak in the tendency to abrade another metal material can be obtained by using a powder material which resembles the aforementioned powder mixture in the present invention but contains a Fe-P alloy powder in place of the Cu-P alloy powder. In the preceding invention the Fe-P alloy powder has the effect of producing a liquid phase of Fe-P-C system during the sintering process and hence promoting the sintering. Accordingly it is possible to achieve sintering at a relatively low temperature to thereby prevent growth of coarse particles of hard borides and/or carbides of Fe and/or Cr.

In the preceding invention, however, sometimes an undesirably large amount of hard steadite phase in intricate shape appears in the sintered alloy as a result of slight variations in the amount of the Fe-P alloy powder and/or the sintering temperature. In such cases the sintered alloy used as the rocker arm tip, for example, becomes relatively strong in the tendency to abrade the opposite cam. Besides, there is the need of impregnating the sintered alloy with oil when the sintered alloy is desired to exhibit very good physical affinity for another metal material since the sintered alloy does not contain any soft metal that contributes to the improvement on the physical affinity.

At the sintering step in the method of the present invention, the Cu-P alloy powder provides a liquid phase at a relatively low temperature, and P contained in the liquid phase reacts with the iron and graphite powders. As a result a liquid phase of Fe-P-C system is readily produced at temperatures not so higher than the aforementioned temperature, and the two liquid phases jointly contribute to the promotion of sintering. Therefore, the sintering can smoothly be achieved by the employment of a relatively low sintering temperature without suffering from growth of coarse particles of the aforementioned hard phases. Meanwhile, a portion of Cu contained in the molten Cu-P alloy separates from the alloy because of a decrease of P in the alloy and subsequently solidifies in the elemental form. In the sintered alloy copper is finely dispersed in the matrix as well as the hard phases of carbides, borides and steadite. Accordingly, the rocker arm tip formed of the sintered alloy is highly resistant to wear and exhibits good physical affinity for the cam.

DESCRIPTION OF THE PREFERRED EMBODIMENTS

Throughout the following description, the amounts of the elements in the respective alloys are given in percentages by weight.

In the present invention a Fe-Cr-B alloy powder is used as the source of Cr and B on which the wear resistance of the sintered alloy primarily depends. In the process of sintering of the compacted powder material, the Fe-Cr-B alloy powder diffuses into the iron base matrix by solid phase diffusion and/or by liquid phase sintering that takes place because of the presence of Cu-P and Fe-P-C liquid phases as the effect of the Cu-P alloy contained in the powder material and a Fe-Cr-B-C liquid phase resulting from combining of the Fe-Cr-B alloy powder with the graphite powder. The content of Cr in the Fe-Cr-B alloy is specified to be from 10 to 35% and the content of B to be from 1.0 to 2.5% for the following reasons.

Cr combines with B contained in the same alloy and also with C and Fe to form borides and carbides which are distributed over the iron base matrix of the sintered alloy. Accordingly it is important that the amount of Cr be balanced with the amounts of B and C. When the content of Cr in the Fe-Cr-B alloy is less than 10% it is difficult to produce a sintered alloy in which the content of Cr is sufficient to afford desirably high wear resistance to the sintered alloy. However, a Fe-Cr-B alloy containing more than 35% of Cr is too high in the hardness of the alloy powder particles so that the alloy powder is inferior in formability.

As mentioned above, B combines with Cr and Fe to form hard borides. When the content of B in the Fe-Cr-B alloy is less than 1.0% the precipitation of borides remains insufficient. When the content of B exceeds 2.5% the precipitation of borides becomes more than sufficient, and the particles of the precipitated borides become undesirably coarse and, besides, the powder becomes inferior in formability.

Usually Fe-Cr-B alloy powders are produced by an atomizing method. A small amount of Si may be added to a Fe-Cr-B alloy for use in the present invention with a view to improving the fluidity of the molten alloy and suppressing the oxidation of the molten alloy in the production of the alloy powder by an atomizing method. In that case the amount of Si should be limited so as not to degrade the important properties of the Fe-Cr-B alloy. When the amount of added Si is less than 0.5% of the alloy the expected effects of Si are hardly appreciable, but it is undesirable to add more than 3.0% of Si because it may cause lowering of the hardness and wear resistance of the sintered alloy.

A powder mixture to be compacted and sintered is prepared so as to contain 15 to 50% by weight of a Fe-Cr-B alloy powder. When the amount of the Fe-Cr-B alloy powder is less than 15%, the amounts of hard phases of borides and carbides in the sintered alloy remain insufficient to afford desirably high wear resistance to the sintered alloy. However, an increase in the amount of the Fe-Cr-B alloy powder in the powder mixture beyond 50% no longer produces a corresponding effect on the wear resistance of the sintered alloy and renders the formability of the powder mixture inferior. In the sintered alloy produced by using a powder mixture containing 15–50% of a Fe-Cr-B alloy which contains 10–35% of Cr and 1.0–2.5% of B, the content of Cr is 1.5–17.5% and the content of B is 0.16–1.25% by calculation. It is preferred to limit the amount of the Fe-Cr-B alloy in the starting powder mixture within the range from 20 to 30% by weight. Then the content of Cr in the sintered alloy becomes 2.0–10.5% and the content of B becomes 0.20–0.75%.

The powder mixture must contain 1.0 to 3.5% by weight of a graphite powder. Graphite or C diffuses into the iron base matrix of the sintered alloy with the effect of enhancing hardness and physical strength of the maxtrix and, besides, diffuses into the Fe-Cr-B alloy powder to form carbides. When the amount of graphite in the powder mixture is less than 1.0% the overall hardness and wear resistance of the sintered alloy remain insufficient. However, when the powder mixture contains more than 3.5% of graphite the sintered alloy becomes brittle and stronger in the tendency to abrade another metal material brought into rubbing contact with the sintered alloy by reason of the precipitation of excessively large amounts of carbides.

In the present invention a Cu-P alloy powder is used as an essential material for the purposes described hereinbefore. Instead of adding Cu and P to the powder mixture separately, use is made of a Cu-P alloy powder with the intention of realizing very intimate contact between Cu and P thereby ensuring that the expected liquid phase is produced in a sufficient quantity at relatively low temperatures and also with a view to minimizing evaporation loss of P during the sintering process.

The amount of the Cu-P alloy powder is controlled such that the prepared powder mixture contains 0.2 to 1.5% by weight of P. The proportion of P to Cu in the Cu-P alloy powder is determined with consideration of a desirable content of Cu in the powder mixture or in the sintered alloy. It is suitable to use a commercially available Cu-P alloy containing 8 to 15% by weight of P, and such an amount of the Cu-P alloy powder is used that the sintered alloy contains 1.0 to 20.0% by weight of Cu together with the aforementioned amount of P.

When the content of P in the powder mixture to be sintered is less than 0.2% by weight the expected effects of P remain insufficient. However, it is undesirable to increase the content of P beyond 1.5% by weight firstly because an excessively large amount of liquid phase is produced in the sintering process to result in that the sintered alloy has coarse surfaces and is unsatisfactory in the dimensional precision, and secondly because there occurs extraordinary growth of steadite phase with the result that the sintered alloy becomes inferior in the smoothness of its rubbing or sliding contact with another metal material.

As the iron powder which provides the matrix of the sintered alloy, it is possible to use either a substantially pure iron powder, which may be atomized iron powder, reduced iron powder or carbonyl iron powder for example, or a low-alloy iron powder which may contain very small amounts of Mn, Cr, Mo and/or V, for example, and can be selected from the low-alloy iron powders used in the current powder metallurgy.

A powder composition prepared in the above described manner is compacted into a desired shape by a conventional compacting method. Preferably the compaction is performed by application of a compression pressure of about 5000–8000 kg/cm$^2$. When the compacting pressure is too low the sintered alloy will suffer from insufficient mechanical strength, but the employment of an unnecessarily high compacting pressure shortens the life of the metal dies for compacting.

The compacted material is subjected to sintering. It is preferred to perform the sintering in vacuum, but it is permissible to perform the sintering in either a reducing atmosphere or an unreactive gas atmosphere on condition that the sintering atmosphere is practically free of oxygen and moisture.

The sintering temperature should be determined carefully. When the sintering temperature is too low it is difficult to realize sufficient dispersion of the Fe-Cr-B alloy in the iron matrix, and therefore the sintered products will possibly suffer from pitting resulting from separation of the borides and carbides when subjected to rubbing friction. When the sintering temperature is so high as to exceed the melting point of the Fe-Cr-B alloy, the sintered alloy tends to have a very hard phase consisting of relatively coarse particles of borides and/or carbides of iron and/or chromium at the grain boundaries and, therefore, seriously abrades the opposite material when subjected to rubbing friction. Accordingly it is necessary to employ a sufficiently high sintering temperature which does not exceed the melting point of the Fe-Cr-B alloy used as a raw material.

It is difficult to strictly specify an optimum sintering temperature firstly because the melting point of a Fe-Cr-B alloy varies depending on its composition and secondly because the temperature at which are produced liquid phases of Fe-Cr-B-C, Fe-Cr-B-P and/or Fe-Cr-B-C-P and the amounts of such liquid phases vary depending on the proportions of C and P added to the Fe-Cr-B alloy. Usually, however, a suitable range of the sintering temperature is from about 1000° C. to about 1140° C. When employing a sintering temperature within this range, it is suitable to perform sintering for about 30 to 60 min. If the duration of sintering is made shorter there arises a possibility of insufficient sintering, but an extension of the sintering time beyond about 60 min is of little effect and sometimes results in softening of the once formed hard borides and carbides.

As to the porosity of the sintered alloy products, the existence of some pores raises no problem and is rather favorable for wear resistance because of the possibility of affording the products with a self-lubricating property by impregnation with oil. However, an unduly high porosity becomes a cause of buckling of the alloy matrix subjected to high load and resultant denting of the alloy surface in rubbing contact with another material. Therefore, it is preferred not to make the porosity of the sintered alloy above 20%.

A sintered alloy according to the invention is excellent in wear resistance. In principle the rocker arm tips or other machine parts formed of this sintered alloy can be used without need of any post-sintering treatment such as heat treatment or surface treatment. However, it is possible and optional to further enhance the wear resistance of the sintered parts by making a heat treatment such as quenching and tempering or a surface treatment such as nitriding insofar as the enhanced hardness of the sintered parts is not seriously unfavorable to the materials subjected to rubbing contact with the sintered alloy parts.

The invention will further be illustrated by the following nonlimitative examples.

EXAMPLE 1

A powder mixture was prepared by mixing 62.5 parts by weight of a reduced iron powder, 30 parts by weight of a Fe-Cr-B alloy powder containing 20% of Cr and 1.5% of B, 2.5 parts by weight of a graphite powder and 5.0 parts by weight of a Cu-P alloy powder containing 15% of P. Each of the powders used as the raw materials consisted of particles that passed through a 100-mesh sieve. With the addition of zinc stearate amounting to 0.75% by weight of the above described powder mixture, thorough mixing was performed for 15 min in a V-shaped blender. In the obtained ferrous powder mixture, the contents of essential alloying elements other than Fe were as shown in Table 1.

The powder mixture was compacted into the shape of a rocker arm tip for an automotive internal combustion engine by application of a pressure of 8000 kg/cm$^2$, and the compacted body was sintered in vacuum ($2\times10^{-2}$ Torr) at 1070° C. for 60 min. The sintered alloy in the form of the rocker arm tip had a porosity of 4%.

EXAMPLE 2

A powder mixture was prepared by mixing 65 parts by weight of a low-alloy Fe powder (passed through an 80-mesh sieve) containing 1.0% of Cr and 0.5% of Mn, 30 parts by weight of a Fe-Cr-B alloy powder (passed through a 100-mesh sieve) containing 15% of Cr and 2.0% of B, 2.5 parts by weight of the graphite powder and 2.5 parts by weight of the aforementioned Cu-P alloy powder containing 15% of P. Thorough mixing was carried out with the addition of zinc stearate amounting to 0.75% by weight of the initially prepared powder mixture. In the obtained ferrous powder mixture, the contents of essential alloying elements were as shown in Table 1.

The powder mixture was compacted into the shape of the aforementioned rocker arm tip by application of a pressure of 8000 kg/cm$^2$, and the compacted body was sintered in vacuum at 1100° C. for 45 min. The sintered alloy in the form of the rocker arm tip had a porosity of 10%.

EXAMPLE 3

A powder mixture was prepared by mixing 74 parts by weight of a low-alloy Fe powder (passed through an 80-mesh sieve) containing 3.5% of Cr, 0.3% of Mo and 0.3% of V, Fe-Cr-B alloy powder (passed through a 100-mesh sieve) containing 25% of Cr and 1.2% of B, 3.0 parts by weight of the graphite powder and 7.0 parts by weight of the aforementioned Cu-P alloy powder containing 15% of P. Thorough mixing was carried out with the addition of zinc stearate amounting to 0.75% by weight of the initially prepared powder mixture. In the obtained ferrous powder mixture, the contents of essential alloying elements were as shown in Table 1.

The powder mixture was compacted into the shape of the rocker arm tip by application of a pressure of 8000 kg/cm$^2$, and the compacted body was sintered in vacuum at 1050° C. for 60 min. The sintered alloy in the form of the rocker arm tip had a porosity of 5%.

EXAMPLE 4

A powder mixture was prepared by mixing 70.5 parts by weight of the reduced iron powder mentioned in Example 1, 20 parts by weight of Fe-Cr-B alloy powder (passed through a 100-mesh sieve) containing 18% of Cr and 1.8% of B, 2.5 parts by weight of the graphite powder and 7.0 parts by weight of a Cu-P alloy powder (passed through an 80-mesh sieve) containing 8.0% of P. Thorough mixing was carried out with the addition of zinc stearate amounting to 0.75% by weight of the initially prepared powder mixture. In the obtained ferrous powder mixture, the contents of essential alloying elements were shown in Table 1.

The powder mixture was compacted into the shape of the rocker arm tip by application of a pressure of 7000 kg/cm$^2$, and the compacted body was sintered in vacuum at 1140° C. for 60 min. The sintered alloy in the form of the rocker arm tip had a porosity of 8%.

TABLE 1

| | Contents of Alloying Elements (Wt %) | | | | |
|---|---|---|---|---|---|
| | Cr | B | C | P | Cu |
| Example 1 | 6.0 | 0.45 | 2.5 | 0.75 | 4.25 |
| Example 2 | 5.15 | 0.60 | 2.5 | 0.375 | 2.12 |
| Example 3 | 6.59 | 0.192 | 3.0 | 1.05 | 5.95 |
| Example 4 | 3.6 | 0.36 | 2.5 | 0.56 | 6.44 |

ENDURANCE TEST

The sintered rocker arm tips produced in Examples 1 to 4 were individually attached to rocker arms, which were used in a 1.8-liter automotive engine. The cams with which the rocker arm tips made rubbing contact were produced by chilled casting of a cast iron consisting of about 3% of C, 2.2% of Si, 0.7% of Mn, 0.2% of P, 0.5% of Cu and the balance of Fe. The hardness of the cam surface was above $H_RC$ 55. The engine was operated over a period of 200 hr to examine the wear resistance and durability of the respective rocker arm tips. To accelerate the wear, the engine was operated with augmented force of the valve spring and with addition of water to the lubricating oil. The details of the test conditions were as follows.

| | |
|---|---|
| Revolutions of Engine | 650 rpm |
| Lubricating Oil | SAE 20 W 40 |
| Lubricating Oil Temperature | 70–80° C. |
| Water Added to Lubricating Oil | 2 Wt % |
| Force of Valve Spring | 86 kg |

The results of the test are presented in the following Table 2 together with the corresponding data obtained by testing the comparative rocker arm tips produced in the reference experiments described below.

REFERENCE 1

A powder mixture was prepared by mixing 78 parts by weight of the reduced Fe powder used in Example 1, 20 parts by weight of the Fe-Cr-B alloy powder used in Example 1 and 2 parts by weight of the graphite powder. With the addition of zinc stearate amounting to 0.75% by weight of the above powder mixture, thorough mixing was carried out for 15 min in a V-shaped blender.

The powder mixture was compacted into the shape of the rocker arm tip by application of a pressure of 8000 kg/cm$^2$, and the compacted body was sintered in hydrogen gas, which was passed through a dehydrating agent in advance, at 1175° C. for 30 min. The sintered alloy in the form of the rocker arm tip had a porosity of 15%.

REFERENCE 2

A powder mixture was prepared by mixing 68.5 parts by weight of a low-alloy Fe powder (passed through an 80-mesh sieve) containing 1.0% of Cr, 0.8% of Mn and 0.26% of Mo, 30 parts by weight of the Fe-Cr-B alloy powder used in Example 2 and 1.5 parts by weight of the graphite powder, with the addition of zinc stearate amounting to 0.75% by weight of the above powder mixture.

The powder mixture was compacted into the shape of the rocker arm tip by application of a pressure of 8000 kg/cm$^2$, and the compacted body was sintered in vacuum at 1190° C. for 45 min. The sintered alloy in the form of the rocker arm tip had a porosity of 5%.

REFERENCE 3

A powder mixture was prepared by mixing 71 parts by weight of Fe powder, which was an atomized iron powder consisting of particles passed through a 100-mesh sieve, 20 parts by weight of a Fe-Cr-B alloy powder which contained 30% of Cr and 1.5% of B and passed through a 100-mesh sieve, 1.0 part by weight of graphite powder, 5 parts by weight of electrolytic Cu powder smaller than 105 μm in mean particle size, 2 parts by weight of atomized Pb powder (passed through a 200-mesh sieve) and 1 part by weight of atomized Sn powder (passed through a 200-mesh sieve), followed by the addition of zinc stearate amounting to 1.0% by weight of the above powder mixture.

The powder mixture was compacted into the shape of the rocker arm tip by application of a pressure of 6000 kg/cm$^2$, and the compacted body was sintered in purified hydrogen gas at 1165° C. for 60 min. The sintered alloy in the form of the rocker arm tip had a porosity of 20%.

REFERENCE 4

A powder mixture was prepared by mixing 78 parts by weight of the low-alloy Fe powder used in Example 3, 16 parts by weight of the Fe-Cr-B alloy powder used in Example 1, 1 part by weight of graphite powder and 5 parts by weight of a leaded bronze powder which contained 10% of Pb and 10% of Sn and passed through a 100-mesh sieve, followed by the addition of zinc stearate amounting to 0.75% by weight of the above powder mixture.

The powder mixture was compacted into the shape of the rocker arm tip by application of a pressure of 8000 kg/cm$^2$, and the compacted body was sintered in purified hydrogen gas at 1170° C. for 30 min. The sintered alloy in the form of the rocker arm tip had a porosity of 13%.

REFERENCE 5

A powder mixture was prepared by mixing 65 parts by weight of the reduced iron powder mentioned in Example 1, 30 parts by weight of the Fe-Cr-B alloy powder used in Example 1, 2.5 parts by weight of the graphite powder and 2.5 parts by weight of a Fe-P alloy powder (passed through a 100-mesh sieve) containing 27% of P. With the addition of zinc stearate amounting to 0.75% by weight of the initially prepared powder mixture, thorough mixing was performed for 15 min in a V-shaped blender.

The powder mixture was compacted into the shape of the rocker arm tip by application of a pressure of 7000 kg/cm$^2$, and the compacted body was sintered in vacuum ($8\times10^{-4}$ Torr) at 1100° C. for 60 min. The sintered alloy in the form of the rocker arm tip had a porosity of 4%.

In the sintered alloys prepared in References 1 to 5, the contents of Cr, B and C were always within the ranges specified in the present invention. However, the sintered alloys of References 1–4 were produced without using P as an alloying element, and in Reference 5 use was made of Fe-P alloy powder instead of Cu-P alloy powder specified in the present invention.

TABLE 2

| | Results of Endurance Test | |
|---|---|---|
| | Amount of Wear of Rocker Arm Tip (μm) | Amount of Wear of Cam (μm) |
| Example 1 | 7–15 | 8–18 |
| Example 2 | 10–18 | 10–15 |
| Example 3 | 6–12 | 10–18 |
| Example 4 | 8–17 | 8–16 |
| Reference 1 | 150–200 | 50–160 |
| Reference 2 | 150–180 | 30–70 |
| Reference 3 | 35–40 | 20–30 |
| Reference 4 | 35–45 | 15–25 |
| Reference 5 | 10–18 | 10–24 |

As can be seen in Table 2, the sintered alloy rocker arm tips produced in Examples 1 to 4 were all very high in wear resistance and very low in the tendency to abrade the cams and can be judged to be superior to the sintered alloy rocker arm tips of References 1 to 5.

What is claimed is:

1. A method of producing a wear-resistant sintered ferrous alloy, the method comprising the steps of:

preparing 100 parts by weight of a powder mixture by mixing 15 to 50 parts by weight of a powder of a Fe-Cr-B alloy which contains 10 to 35% by weight of Cr and 1.0 to 2.5% by weight of B, 1.0 to 3.5 parts by weight of a graphite powder, such an amount of a Cu-P alloy powder that the prepared powder mixture contains 0.2 to 1.5% by weight of P and 1.0 to 20.0% by weight of Cu and the balance of an iron powder;

compacting said powder mixture into a body of a desired shape; and sintering said body in a nonoxidizing atmosphere.

2. A method according to claim 1, wherein said Cu-P alloy powder contains 8 to 15% by weight of P.

3. A method according to claim 1, wherein said iron powder is a substantially pure iron powder.

4. A method according to claim 1, wherein said iron powder is a low-alloy iron powder.

5. A method according to claim 1, wherein the amount of the Fe-Cr-B alloy powder in the first step is in the range from 20 to 30 parts by weight.

6. A method according to claim 1, wherein said Fe-Cr-B alloy contains up to 3.0% by weight of Si.

7. A method according to claim 1, wherein the sintering is performed at a temperature in the range from about 1000° C. to about 1140° C.

8. A wear-resistant sintered ferrous alloy consisting essentially of 1.5 to 17.5% of Cr, 0.15 to 1.25% of B, 1.0 to 3.5% of C, 0.2 to 1.5% of P, 1.0 to 20.0% of Cu, by weight, and the balance of Fe.

9. A sintered ferrous alloy according to claim 8, wherein the content of Cr in the alloy is in the range from 2.0 to 10.5% by weight, and the content of B is in the range from 0.20 to 0.75% by weight.

10. A sintered ferrous alloy according to claim 8, wherein the porosity of the sintered alloy is not greater than 20%.

* * * * *